United States Patent [19]

Bills

[11] 4,202,361

[45] May 13, 1980

[54] POCKET BRUSH

[76] Inventor: John E. Bills, 667 Osceola Ave., Apt. C, Winter Park, Fla. 32789

[21] Appl. No.: 900,165

[22] Filed: Apr. 26, 1978

[51] Int. Cl.[2] ..... A45D 24/10

[52] U.S. Cl. ..... 132/123; 15/203

[58] Field of Search ..... 132/85, 123, 120; 15/203, 184, 159

[56] References Cited

U.S. PATENT DOCUMENTS

| | | | |
|---|---|---|---|
| 1,631,011 | 5/1927 | Connor | 132/85 X |
| 2,832,088 | 4/1958 | Peilet et al. | 15/203 |
| 2,881,460 | 4/1959 | Baudouin | 15/184 |
| 3,706,111 | 12/1972 | Curtin | 15/159 |
| 4,137,596 | 2/1979 | Carlson | 15/203 |

*Primary Examiner*—G. E. McNeill

*Attorney, Agent, or Firm*—John F. McClellan, Sr.

[57] ABSTRACT

An improved and extremely economical brush for hair-brushing and the like folds flat with bristles retracted for pocket carriage; in preferred embodiment the structure includes a plurality of tufts of bristles in unitary ranks, each rank having pivotal connection laterally to opposed walls of an open-top box-shaped casing; a sliding top on the casing has a respective aperture therethrough receiving each tuft; when the top is held at one slidable limit the tufts are pivoted to upright, operative position by the aperture structure, and when the top is held at the other slidable limit, the tufts are folded flat with tips shielded in the apertures by withdrawal into the thickness of the top; lateral extension of the top provides for actuation and a releasible latch holds the top at operative slidable limit.

In a second embodiment a plurality of rubber bristles in unitary ranks is held in similar manner to that described; in both embodiments angling of the aperture in the slidable top assures proper retraction and extension of the bristles, and a choice of brush actions.

3 Claims, 8 Drawing Figures

POCKET BRUSH

This invention relates generally to brushes and particularly to hairbrushes having parallelogramming action retractable bristles permitting folding and carriage by the user in a small pocket of a garment.

Principal objects of the invention are to provide an improved, uniquely simple brush of the type described, with unique sliding plate structure permitting selective mode of use, rattle-free action, extreme economy of parts and of manufacturing cost, adaptability to more than one type tuft and easy cleaning, all in a compact, durable unit which is pleasing in appearance.

In the prior art, numerous folding brush structures have been disclosed including those of the following U.S. Patents:

U.S. Pat. No. 818,696 to R. Kulenkamff, Apr. 24, 1906, discloses slidable bar engaging curved fingers which are mounted on the underside of bristle carriers.

U.S. Pat. No. 2,525,209 to L. C. Davis, Oct. 10, 1950, discloses parallelogramming pivot of bristles;

U.S. Pat. No. 2,814,819 to A. P. DeAyerbe, Dec. 3, 1957, discloses bristle holders and retraction of bristles under a cover;

U.S. Pat. No. 3,977,420 to S. A. Yalof, Aug. 31, 1976, discloses rack & pinion pivoting of tine holding rods for retracting comb structure; and U.S. Pat. No. 4,028,768 issued June 14, 1977, discloses structure in which the bristles slide in upper structure and are held by pivotal structure at the lower end.

However, the known prior art fails to provide the advantages of the present invention in accordance with the objects set forth.

In brief summary given for cursive descriptive purposes only, and not as limitation, the invention includes an open top casing having a sliding plate at the top with a plurality of perforations coacting for concurrent folding of a plurality of tufts in the perforations and having pivotal connection to the casing.

The above and other objects and advantages will become more readily apparent on examination of the following description, including the drawings, in which like reference numerals denote like parts.

Figure 1:
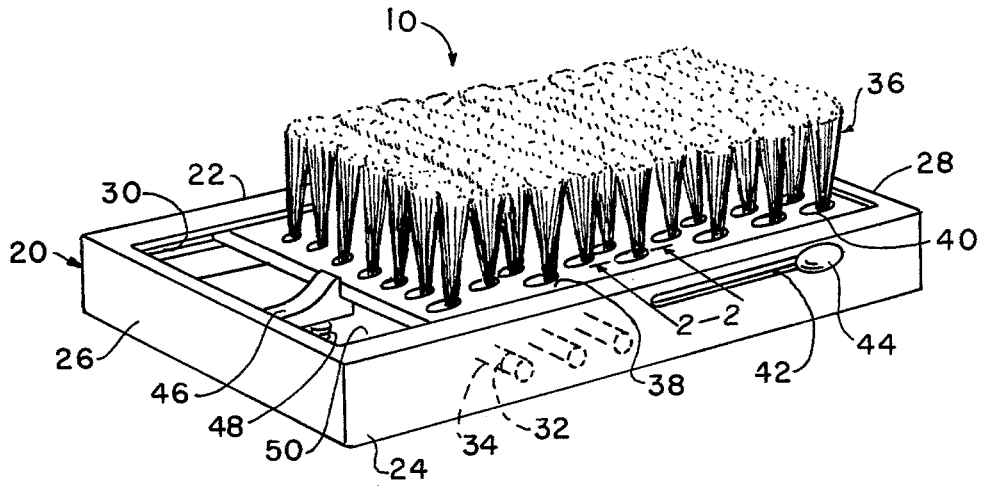
FIG. 1 is an isometric view of a first embodiment of the invention in operative position for brushing.

FIG. 1 shows the first embodiment 10 of the invention in the form of an open-top box-like casing 20 having in-plane around the upper inner part of the sides 22, 24 and ends 26, 28 a continuous groove 30.

Below and paralleling the groove plane is a series of recesses 32 in uniformly spaced relation and in corresponding, opposed locations, along the lower inner wall of each side.

Across the casing adjacent the bottom, in each opposed pair of recesses a rod 34 is pivotally mounted. Each of these transverse rods had spaced along the length a plurality of tufts 36 held, with the free ends in substantially parallel protrusion from the rod, by clamping, crimping, cementing, moulding or by otherwise conventionally affixing the bases of the tufts to the rods. Tufts in alternate rows may be offset.

Rectangular plate 38 relatively shorter than the casing in length is longitudinally slidably held in the groove in the casing and has a plurality of perforations 40 spaced in correspondence with the tuft spacing, each receiving a respective tuft with the tuft bristles freely protrusive in the operative position shown.

Longitudinal slot 42 through a side into the groove plane permits plate extension 44 to protrude laterally through the side (or sides if two in opposed locations are employed) for manual urging of the plate to slide in the groove from the operative position or first slidable position to the folded position or second slidable position at the opposite extreme of sliding movement. In side view, relative parallelogramming of the tufts relative to the plate and rods folds the bristles, preferably into the thickness of the plate.

Releasible notched stop 46 held by spring 48 mounted to the bottom 50 holds the plate in the operative position; when the stop is depressed, releasing the plate from the notch, the plate can be slid to the folded position. In place of the spring, the stop can have a molded flexible connection so that it is an integral part of the casing, if desired.

Figure 2:
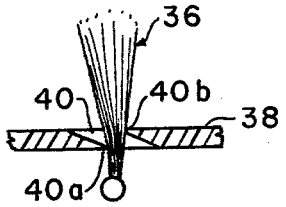
FIGS. 2 and 3 are respectively use-configuration and folded-configuration sectional detail views adapted from 2—2, FIG. 1.
Figure 3:
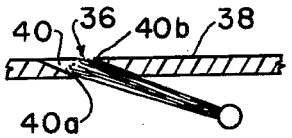
Figure 4:
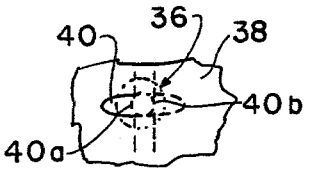
FIG. 4 is a plan diagrammatic detail of a portion like that of the FIG. 2 detail.

FIGS. 2, 3 and 4 illustrate an important preferred provision of the invention, slot-shape of the perforations 40 and also outward incline in the direction of the second slidable position of plate 38. The incline and slot shape of the perforations further combine with the substantial thickness of the plate. Preferably the slot-shaped perforations have rounded ends. These features and the relative proportions of the coacting plate and the tufts 36 impart quality-action, versatility, and efficiency, as follows.

A problem which can exist with bristles in any structure in which they move axially is solved by this provision, which also, is evident, yields a further and surprising advantage. Apertures which are not large enough will tend to buckle fine bristles because of sliding friction with tight fitting tufts. Yet tight holding of tufts for definite positioning of bristles during brushing is necessary to provide efficient brushing action and to prevent the user from feeling that the bristles are flopping around while brushing.

Examination of these three Figures will indicate how the individual tufts 36 in brushing attitude are rididly clamped in the slotted-shape perforations between perforation lower edge **40*a* on the left and upper edge 40*b*** on the right.

The clamping takes place just as the plate reaches the limit of travel so that as the pressure on the tufts is applied the clamping edges approach the tufts at nearly a perpendicular angle rather than sliding along them. The preferably curved (in plan view) ends of the slots gather and help stabilize the tufts clamped. Yet, when being urged to the folded configuration the tufts find immediate release and generous room provided by the relatively long slots.

In the folded configuration, the proportion of the thickness of the plate is made to receive parallel and shield the laid-over bristly ends of the tufts from abrasion in the pocket, and to prevent danger of initial buckling when redeployed for brushing.

A surprising selective-brushing advantage resulting from the perforation incline is evident in these Figures also. It will be seen that stiff bristle-action results from brushing side-to-side and in one longitudinal direction because the perforation sides and edge 40b at the top of the plate support the bristles against bending at a location nearer the tips.

Softer brushing action is obtainable merely by turning the brush and brushing in the other longitudinal direction with edge 40a at the bottom of the plate supporting the bristles farther from the tip and permitting more bristle bending.

Because of these features bristles of a wider variety than otherwise can be employed in the brush, coarse or fine and of natural or synthetic fibre, as desired. Similarly, frictional characteristics of materials for the plate are of less importance, permitting selection from a wider range of materials.

Figure 5:
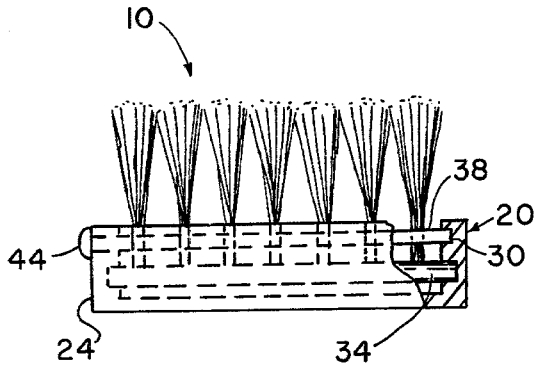
FIG. 5 is an end elevational view partly broken away for exposition.

FIG. 5 shows that the bristles may be permitted to spread laterally; each folding separates and realigns them.

Figure 6:
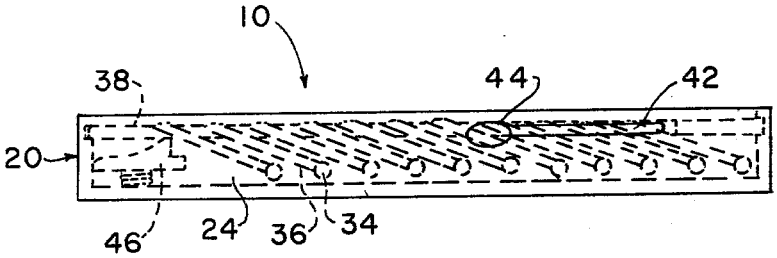
FIG. 6 is a side elevational view showing the folded or storage configuration.

FIG. 6 illustrates the compactness and bristle protection in the folded configuration, and the retracted sliding-position of the top and retracted position of the stop.

Figure 7:
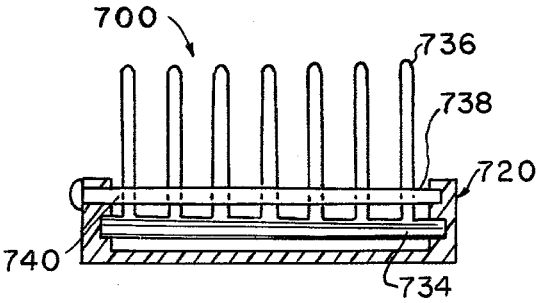
FIG. 7 is a transverse sectional detail of a second embodiment differing from the first embodiment in tuft structure.

FIG. 7 shows an alternative embodiment 700 with soft plastic or rubber bristles or "tufts" 736 which may be integrally molded to the supporting rod 734 in ranks. In this elastomeric-tuft embodiment as in the first embodiment the perforations 740 are together at an angle longitudinally to the plane of the plate proportioned to the plate thickness and tuft to produce in the operational position tuft clutching by catercornered portions of the perforate structure defining the slot, and are of a width permitting free sliding of the tufts when no so-clutched.

Figure 8:
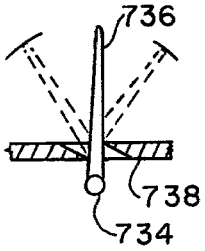
FIG. 8 is a detail of the second embodiment in similar view to the view of FIG. 2.

FIG. 8 indicates that regardless of whether the bristles or "tufts" are tapered or otherrwise non-uniform or distortable they will be securely clamped and freely released when desired by the inclined perforations, and can provide two degrees of tuft flexibility (dotted lines) as in the previous embodiment. Although in the appended claims "tufts" may be recited, it will be appreciated that the term covers corresponding parts of both embodiments disclosed herein, including massive single elastomeric bristles.

Materials for the casing can be thermoplastic such as polyethylene and may be flexible, facilitating assembly; the plate and rods can be of similar material, either rigid or flexible. Bristles in the first embodiment can be, as indicated, any suitable fibre, natural or artificial.

In conclusion, it will be seen that the invention according to the objects provides a substantially snag-free, smooth brush face to the user but with an always ventilated interior, easily rinsed out when desired, together with an unobtrusive, pleasing appearance, and with only three differently-made parts (assuming that the stop is integrally molded), affording extreme economy in parts needed for unfolding, holding, folding and shielding the tufts.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be secured by U.S. Letters Patent is:

1. In a brush employing parallelogramming action for folding a plurality of free-end tufts having connection to a casing permitting at least a portion of each tuft to pivot at the base of the tuft relative to the casing, and means for pivoting at least a portion of each tuft, the improvement comprising: the means for pivoting including a plate having a plurality of perforations with respective upper and lower edges, each perforation directly receiving therein a respective tuft intermediate said connection to the casing and free-end of the tuft, means slidably connecting the plate and casing in location operatively extending the free ends of the tufts from the plate at a first slidable position and retracting the free ends of the tufts at a second slidable position, and means affording selection of tuft stiffness for brushing including said perforations being inclined outwardly in the plate in the direction of the second slidable position, the plate having proportion causing catercornered clamping of each of the tufts between a said upper edge and a lower edge of a perforation at the first slidable position.

2. In a brush as recited in claim 1, the tufts comprising single elastomeric bristles, said tuft pivotal connection to the casing including the single elastomeric bristles being mounted in plural ranks on a respective plurality of rods respectively integral with each rank, and each rod having pivotal connection to the casing.

3. In a brush having a casing, a plurality of tufts having at one end thereof pivotable mounting to the casing, the improvement comprising: a plate with structure defining therethrough a plurality of inclined perforations having respective upper and lower edges, a portion of the casing spaced from said pivotable mounting of the tufts to the casing holding the plate movably between a first position and a second position; the plate holding upright in the first position respective tufts by contact on a first side of each tuft with a said upper edge and by contact on a second side of each tuft, opposite to the first side, with a said lower edge, of a respective inclined perforation; and said plate inclining said tufts substantially parallel within the inclined perforations in said second position.

* * * * *